US007799500B2

(12) United States Patent
Kobayashi et al.

(10) Patent No.: US 7,799,500 B2
(45) Date of Patent: Sep. 21, 2010

(54) IMAGE FORMING METHOD

(75) Inventors: Makoto Kobayashi, Koganei (JP); Shingo Fujimoto, Fussa (JP); Takao Yamanouchi, Sagamihara (JP); Kazuya Isobe, Hachioji (JP); Hirofumi Koga, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 822 days.

(21) Appl. No.: 11/602,759

(22) Filed: Nov. 21, 2006

(65) Prior Publication Data

US 2007/0178399 A1 Aug. 2, 2007

(30) Foreign Application Priority Data

Jan. 31, 2006 (JP) ..... 2006-022566

(51) Int. Cl.
*G03G 13/20* (2006.01)

(52) U.S. Cl. ..... 430/124.3; 430/108.1; 430/108.4; 430/108.8; 430/111.4

(58) Field of Classification Search ..... 430/124.3, 430/108.8, 108.4, 108.1, 111.4
See application file for complete search history.

(56) References Cited

U.S. PATENT DOCUMENTS

| | | | | |
|---|---|---|---|---|
| 5,541,719 | A * | 7/1996 | Tamaki | 399/335 |
| 6,203,959 | B1 * | 3/2001 | Tanikawa et al. | 430/108.8 |
| 7,169,726 | B2 * | 1/2007 | John et al. | 502/64 |
| 2004/0053153 | A1 * | 3/2004 | Yaguchi et al. | 430/106.1 |
| 2005/0175923 | A1 * | 8/2005 | Nakazawa et al. | 430/110.3 |
| 2006/0172211 | A1 * | 8/2006 | Ueda et al. | 430/108.4 |

FOREIGN PATENT DOCUMENTS

| | | |
|---|---|---|
| JP | 2000-275908 | 10/2000 |
| JP | 2000-321815 | 11/2000 |

* cited by examiner

*Primary Examiner*—Janis L Dote
(74) *Attorney, Agent, or Firm*—Cantor Colburn LLP

(57) ABSTRACT

Disclosed is an electrophotographic image forming method which comprises steps of forming a toner image on an image support, fixing the toner image on the image support in a fixing nip section of a fixing device employing a contact heating system and the toner contains a first releasing agent, a dynamic viscosity of the first releasing agent is 4-20 $mm^2$/sec; and a fixing temperature in the fixing nip section of the fixing device is 75-100° C. higher than a melting point of the first releasing agent.

10 Claims, 2 Drawing Sheets

IMAGE FORMING METHOD

This application claims priority from Japanese Patent Application No. JP2006-022566, filed on Jan. 31, 2006, which is incorporated hereinto by reference.

FIELD OF THE INVENTION

The present invention relates to an image forming method based on an electrophotographic method.

BACKGROUND OF THE INVENTION

Recently, higher color image production rates employing electrophotography have been demanded. In order to realize the above higher rates, sought is a toner capable of consistently producing color images during color image production at a higher rate.

However, when color images are produced at a higher rate, period passing the fixing nip section in a fixing device decreases resulting in a decrease in pressurizing/heating energy provided to the toner, whereby it has been difficult to consistently produce color images due to occasional formation of image defects due to insufficient image fixing, such as the offsetting phenomena.

On the other hand, energy conservation in an image forming apparatus employing an electrophotographic method has also been demanded. In the above image forming apparatus, to decrease energy consumption in the most power consuming fixing unit, research for a method to achieve fixing at a lower fixing temperature have been conducted. In order to realize lower temperature fixing, it is necessary to melt toner particles and releasing agents at lower temperatures. In order to archive the above, it is commonly required to employ components exhibiting lower melting viscosity as a toner and a releasing agent (being wax), and also to employ components exhibiting a lower melting point as the releasing agent. Thus, toners are proposed which employ such releasing agents (hereinafter also referred to as specified lower melting point releasing agents) exhibiting lower melting viscosity and low melting point (refer, for example, to Patent Documents 1 and 2).

However, fixed images, which are formed employing toners incorporating such specified lower melting point releasing agents, result in problems in which image defects in the form of banding and streaking tend to occur.

Causes of the above problems are studied to result in finding in which molecules of the releasing agents adhere to the interior of the apparatus to adversely affect charging properties, and to also result in mirror staining. Inherently, releasing agents themselves exhibit a low melting point but a very high boiling point, whereby it has not been assumed that they vaporize. However, it was assumed that in order to realize lower temperature fixing, as the melting point of releasing agents is lowered, the vapor pressure at lower than or equal to the boiling point decreases to result in an increase in vaporized molecules of the releasing agents or molecules having an easily vaporized structure. Namely, it was found that image defects occurred in the following manner. When images were formed, via thermal fixing, employing toners incorporating low melting point releasing agents, vaporized components were generated, from heat in the apparatus, due to the fact that the low melting point releasing agents themselves incorporated relatively easily vaporized components, whereby the above vaporized components adhered to the wires of the charging units to result in non-uniform charging, or onto polygonal mirrors to result in streaking defects during exposure.

(Patent Document 1) Japanese Patent Publication Open to Public Inspection (hereinafter referred to as JP-A) No. 2000-321815

(Patent Document 2) JP-A No. 2000-275908

In view of the foregoing, the present invention was achieved. An object of the present invention is to provide an image forming method capable of forming excellent fixed images in such a manner that by employing a toner incorporating low melting point releasing agents, even under high rate fixing, sufficiently strong fixing is carried out to minimize formation such as offsetting phenomenon and also to minimize image defects in the form of banding or streaking in the resulting fixed images.

In a fixing device employing a high-rate contact heating system, when a fixing temperature is elevated 50-100° C. higher than the melting point of the releasing agent so that the releasing agents function sufficiently, generation of vaporized components tend to be accelerated in such a manner that the releasing agents are subjected to effects due to heat. The inventors of the present invention found that a releasing agent, which exhibited a melting point nearly the same as the fixing temperature, resulted in difference in the amount of vaporized components. It was assumed that the cause was due to the intertwined structure of the releasing agent. Subsequently, the present invention was accomplished by specifying a dynamic viscosity of the releasing agent.

Though the reason is not well understood, it is assumed to be as follows. It is possible to regard the dynamic viscosity as an index of the relative ease of motion of molecular chains. By controlling the dynamic viscosity within a specified range, it is possible to limit the motion of molecular chains within that range. As a result, since it is possible to design in such a manner that when the components of releasing agent are thermally affected in the apparatus, a state is maintained in which molecular motion is not activated, and when thermally affected in the fixing device, the molecular motion is activated, it is possible to retard generation of vaporized components while maintaining the low temperature fixability.

The image forming method of the present invention is one in which a fixed image is prepared in such a manner that a toner image formed on the image support employing toners is fixed in the fixing nip section of the fixing device, employing a contact heating system. Toner, employed herein, contains a releasing agent in which:

the dynamic viscosity of the releasing agent is 4-20 $mm^2$/second; and the fixing temperature in the fixing nip section of the above fixing device is 50-100° C. higher than the melting point of the releasing agent, and particularly 75-100° C. higher than the melting point of the releasing agent.

In the image forming method of the present invention, the melting point of the above releasing agent is preferably 50-100° C. Further, the dynamic viscosity of the above releasing agents is preferably 8-15 $mm^2$/second. Still further, it is preferable that the above releasing agent is composed of at least two types of releasing agents which exhibit a dynamic viscosity of 8-15 $mm^2$/second.

In the image forming method of the present invention, the transport rate (hereinafter also referred to as the "printing rate") in the fixing nip section is preferably 230-500 mm/second.

Based on the image forming method of the present invention, releasing agents contained in an employed toner exhibit a specified dynamic viscosity and at the same time, the melting point of the above releasing agent is within the specified range with respect to the fixing temperature in the fixing device. Consequently, even though fixing is carried out at a high rate, the releasing agents sufficiently melt to retard generation of phenomena such as offsetting, and minimize generation of vaporized components of the releasing agents to minimize formation of image defects in the form of banding and streaking on the fixed images, whereby it is possible to produce excellent fixed images.

DETAILED DESCRIPTION OF THE INVENTION

The present invention and preferred embodiments thereof will now be described.

(Image Forming Method)

The image forming method of the present invention is one in which fixed images are prepared in such a manner that a toner image formed on an image support, employing toners incorporating releasing agents, is fixed in the fixing nip section of a fixing device employing a contact heating system.

The contact heating system, as described herein, refers to a system in which fixing is carried out in such a manner that a toner image on an image support is brought into contact with the surface of the fixing section member in the fixing device, followed by application of heating. Pressure may be applied in addition to the heating.

In the image forming method of the present invention, fixing is carried out in such a manner that the fixing temperature in the fixing nip section of the fixing device is 50-100° C. higher than the melting point of used releasing agent.

The fixing temperature, as described herein, refers to the surface temperature of the fixing member which comes into contact with the surface on which a toner image is formed on the image support in the fixing nip section.

A model of heating device preferably employed for an image forming method of the present invention.

Figure 1:
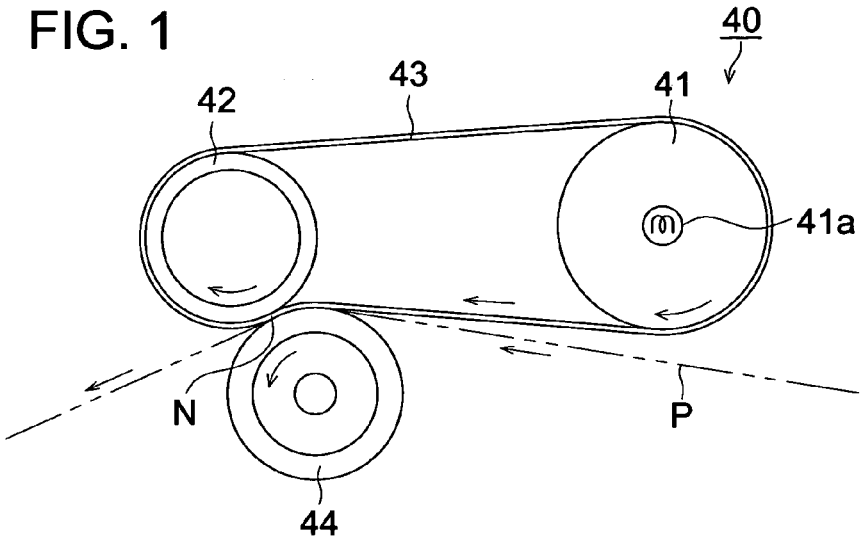
FIG. 1 is a schematic view of a fixing device which may be employed for the invention.
Figure 2:
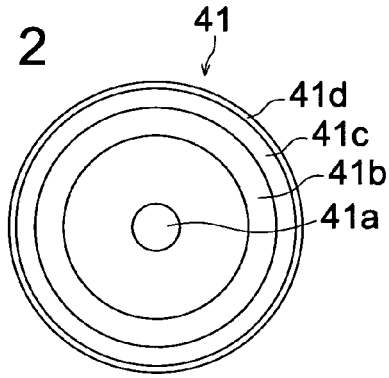
FIG. 2 is a schematic view of an example of a heating roller which may be employed for a fixing device of FIG. 1.

FIG. 1 is a schematic view of a fixing device which may be employed for the invention. FIG. 2 is a schematic view of an example of a heating roller which may be employed for a fixing device of FIG. 1.

Fixing device 40 incorporates heating roller 41 incorporating heating source 41*a* composed of a halogen heater lamp, supporting roller 42 which is arranged separately from and parallel to above heating roller 41, looped fixing belt 43 which is entrained around heating roller 41 and supporting roller 42, and pressure roller 44 which forms nip section N in such a manner that it is brought into pressure contact with supporting roller 42 via above fixing belt 43.

Above heating roller 41 of fixing device 40 is structured as follows. Heat-resistant plastic layer 41*c*, of a thickness of 1.5 mm, composed for example of silicone rubber, is formed on cylindrical metal core 41*b* composed, for example, of aluminum, and further, 30 μm thick toner releasing layer 41*d* composed, for example, of PFA (being tetrafluoroethylene-perfluoroalkyl vinyl ether copolymers) resin is formed which is employed as the uppermost layer via 1-3 adhesion layers (not shown).

Fixing belt 43 is prepared as follows. A Si rubber layer of a thickness of about 200 μm is formed on the peripheral surface of substrates such as an about 40 μm thick Ni electroplated substrate or a 50-100 μm thick polyimide substrate, and subsequently, a covering layer composed of a about 30 μm thick PFA or PTFE (polytetrafluoroethylene) is preferably formed on the peripheral surface of the above Si rubber layer.

One example of the fixing conditions employing the fixing device shown in FIG. 1 follows. Fixing temperature (being the surface temperature of fixing belt 43 in fixing nip section N) is 70-210° C. and the nip width of fixing nip section N is commonly 5-40 mm, but is preferably 11-30 mm. The nip width of fixing nip section N refers to the contact width of toner image T formed on image support P with the surface of fixing belt 43. Further, contact load between supporting roller 42 and pressure roller 44 is commonly 40-350 N, but is preferably 50-300 N.

In the image forming method of the present invention, even though images are formed at a high printing rate such as 230-500 mm/second, it is possible to sufficiently realize the above effects. Further, by practicing the printing rate of 230-400 mm/second, it is possible to more efficiently realize the desired effects.

Figure 3:
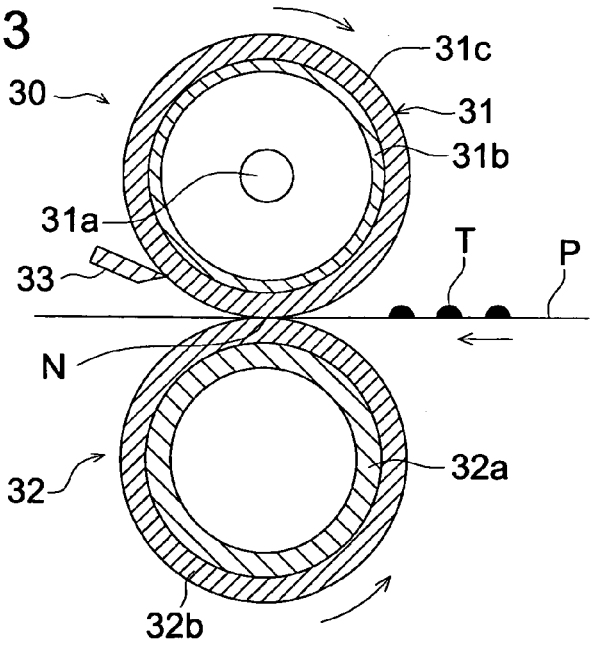
FIG. 3 is a schematic view of another model of a fixing device which may be employed for the invention.

FIG. 3 is a sectional view showing another example of the structure of a fixing device, employed in the image forming method of the present invention.

Fixing device 30 is provided with heating roller 31 and pressure roller 32 which is brought into contact with the above. Further, in FIG. 3, T is a toner image formed on image support P and 33 is a separation claw.

Heating roller 31 is constituted in such a manner that covering layer 31*c* composed of silicon resins or elastic materials is formed on the surface of metal core 31*b* and includes heating member 31*a* composed of a linear heater.

When the thickness of the covering layer composed of fluororesins is less than 10 μm, it is not possible to sufficiently realize functions as a covering layer, whereby it is not possible to secure durability as a fixing device. On the other hand, the surface of the covering layer of a thickness exceeding 500 μm tends to be subjected to abrasion due to paper powder, whereby problems occur in which images are stained due to adhesion of toners onto the above abrasion.

The metal central shaft 31*b* is composed of a metal or an alloy thereof and the internal diameter of the shaft is preferably from 10 to 70 mm. As the material of the shaft, for example, iron, aluminum and copper and an alloy thereof are usable.

The thickness of the metal shaft is preferably from 0.1 to 2 mm, which is decided considering the balance of the requirement of the energy saving by thinning and the strength depending on the material. For example, it is preferable that the thickness of the shaft of aluminum is controlled to 0.8 mm for obtaining strength the same as that of the shaft made from iron with a thickness of 0.57 mm.

The cover layer 31*c* may be constituted by a fluorine resin whose examples include PTFE (polytetrafluoroethylene), PFA (tetrafluoroethylene-perfluoroalkoxyvinyl ether copolymer) and so on.

The thickness of the cover layer 31*c* is from 0.1 to 30 mm, preferably from 0.1 to 20 mm when it is constituted by a fluorine resin.

The cover layer 31*c* may be constituted by a silicone rubber, examples of which include a silicone rubber such as LTV, RTV and HTV and a sponge thereof.

The thickness of the cover layer 31*c* is from 0.1 to 30 mm, preferably from 0.1 to 20 mm when it is constituted by an elastic material.

The Ascar hardness of the elastic material constituting the cover layer 31*c* is preferably less than 80°, more preferably less than 60°.

A halogen heater can be suitably used as the heating member 31*a*.

The pressure roller 32 is composed of a metal shaft 32*a* and a cover layer 32*b* of an elastic material formed on the surface of the shaft. The elastic material includes, a soft rubber or sponge rubber such as urethane rubber and silicone rubber. Preferably examples are silicone rubber and silicone sponge rubber cited as a cover layer material of a heat roller cover layer 31*c*.

As the material of the shaft 31, for example, iron, aluminum and copper and an alloy thereof are usable The thickness of the cover layer 32*b* is from 0.1 to 30 mm, preferably from 0.1 to 20 mm.

One example of fixing conditions employing the fixing device shown in FIG. 3 is as follows. Fixing temperature (being the surface temperature of heating roller 31) is 70-210° C., and the nip width of fixing nip section N formed by heating roller 31 and pressure roller 32 is commonly 5-40 mm, but is preferably 11-30 mm. The nip width of fixing nip section N, as described herein, refers to the contact part of toner image T, formed on image support P, with the surface of heating roller 31. Further, contact load between heating roller 31 and pressure roller 32 is commonly 40-350 N, but is preferably 50-300 N.

In the image forming method of the present invention, even though images are formed at a high rate printing at 230-500 mm/second, it is possible to sufficiently obtain the above targeted effects, but when the printing rate is at 230-400 mm/second, it is possible to more sufficiently obtain them.

Figure 4:
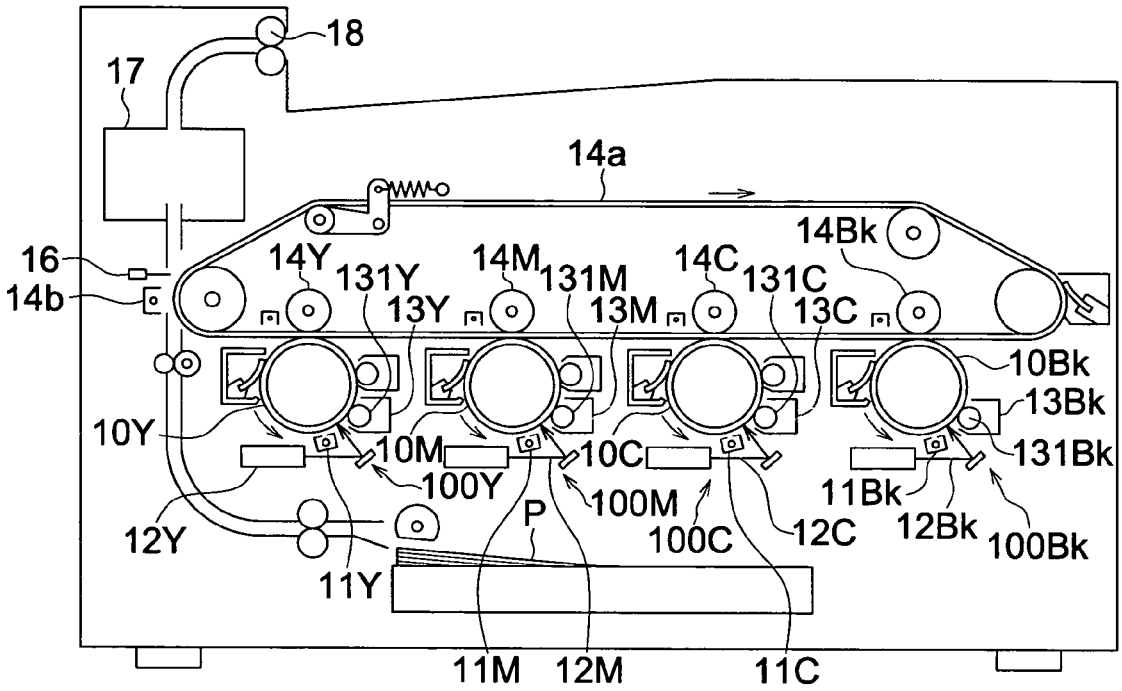
FIG. 4 is a schematic view of an image forming apparatus which may be employed for the invention.

FIG. 4 is an explanatory view showing one example of the image forming apparatus employed in the image forming method of the present invention.

This image forming apparatus is a tandem system color image forming apparatus which is constituted in such a manner that four groups of image forming units 100Y, 100M, and 100C, and 100Bk are arranged along intermediate belt 14*a* which serves as an intermediate transfer body.

In each of image forming units 100Y, 100M, 100C, and 100Bk, a conductive layer and a photoconductor layer composed of organic photoconductors (OPC) are formed on the peripheral surface of a cylindrical substrate. Each unit incorporates photoreceptor drums 10Y, 10M, 10C, and 10Bk which rotate counter-clockwise via power from a driving source (not shown) or is driven via intermediate belt 14*a*, while the conductive layer is grounded, charging means 11Y, 11M, 11C, and 11Bk, composed of a scorotron charger, which provide a uniform potential on the surface of above photoreceptor drums 10Y, 10M, 10C, and 10Bk via corona discharge exhibiting the same polarity as the toner, which are arranged in the direction at right angles to the moving direction of photoreceptor drums 10Y, 10M, 10C, and 10Bk, exposure means 12Y, 12M, 12C, and 12Bk which form a latent image via image exposure based on image data on the surface of uniformly charged photoreceptor drums 10Y, 10M, 10C, and 10Bk via performing scanning parallel to the rotation axis of photoreceptor drums 10Y, 10M, 10C, and 10Bk, by employing, for example, polygonal mirrors, and rotating development sleeves 131Y, 131M, 131C, and 131 Bk, and further development means 13Y, 13M, 13C, and 131Bk which convey the toner retained on those to the surface of photoreceptor drums 10Y, 10M, 10C, and 10Bk.

In the above, a yellow toner image is formed via image forming unit 100Y, a magenta toner image is formed via image forming unit 100M, a cyan toner image is formed via image forming unit 100C, and a black toner image is formed via image forming unit 100Bk.

In the above image forming apparatus, the toner image of each color, which is formed on each of photoreceptor drums 10Y, 10M, 10C, and 10Bk of each of image forming units 100Y, 100M, 100C, and 100Bk, is successively transferred and superposed onto image support P which is conveyed while matched to timing, employing transfer means 14Y, 14M, 14C, and 14Bk, whereby a full color toner image is formed. All the resulting superposed toner images are simultaneously transferred onto image support P via secondary transfer means 14*b*, separated from intermediate belt 14*a* via separation means 16, fixed in fixing device 17, and finally discharged through discharge outlet 18 to the exterior of the apparatus.

Image Supporting Material

Specifically provided are various image receiving materials such as plain paper sheets from a thin paper sheet to a thick paper sheet, an art paper sheet, printing paper sheets of a coated paper sheet and such, commercially viable Japanese paper or post card paper sheet, a plastic film sheet for OHP, and cloth.

(Toners)

Toners employed in the image forming method of the present invention incorporate releasing agents, and can be prepared, for example, as described below, via a mini-emulsion polymerization aggregation method, employing binding resins, colorants, and releasing agents.

(Releasing Agents)

The dynamic viscosity of above releasing agents is commonly 4-20 $mm^2$/second, but is preferably 8-15 $mm^2$/second. When releasing agents of a dynamic viscosity of less than 4 $mm^2$/second are employed, molecules of releasing agents are less intertwined with each other, it is afraid that generation of vaporizing components may be accelerated. On the other hand, when releasing agents of a dynamic viscosity of at least 20 $mm^2$/second are employed, it is a concern that at a low fixing temperature, no highly uniform releasing agent layer is formed to make it impossible to realize sufficient releasing properties, whereby problems may occur in which low temperature offsetting phenomena result.

The dynamic viscosity, as described herein, refers to the value which is determined at 100° C., employing the suspended liquid surface type Ubbelohde viscometer described in JIS K 2283. Measurement was carried out, when the dynamic viscosity was 2-10 $mm^2$/second, employing a viscometer of a viscometer constant of 0.01, of which number was 1. Measurement was carried out when the dynamic viscosity was 10-30 $mm^2$/second, employing a viscometer of a viscometer constant of 0.03, of which number was 1C.

The releasing agents include Natural wax, such as carnauba wax, rice wax, and montan wax; polyolefin wax, such as polyethylene wax, and polypropylene wax; hydrocarbon wax such as Fischer-Tropsch wax, paraffin wax and microcrystalline wax; ester wax such as mono-ester wax, polyvalent ester wax, and condensation type ester wax; amide wax; and ketone system wax.

The wax may be used singly or plurality in combination.

The Fischer-Tropsch wax, paraffin wax, microcrystalline wax and mono-ester wax are preferably employed in view of low generation of volatile component and having low dynamic viscosity, among those mentioned above.

Examples of a microcrystalline wax usable in the present invention include: HNP-0190, HI-MIC-1045, HI-MIC-1070, HI-MIC-1074, HI-MIC-1080, HI-MIC-1090, HI-MIC-2045, HI-MIC-2065, and HI-MIC-2095 all of which are produced by Nippon Seiro, Co., Ltd.

Employed as micro-crystalline waxes are those of a low molecular weight such as a weight average molecular weight of 600-800. Of such waxes, those of a number average molecular weight of 300-1,000 are preferred, but those of 400-800 are more preferred. Further, ratio Mw/Mn of the weight average molecular weight to the number average molecular weight is preferably 1.01-1.20.

The melting point of all the releasing agents, which constitute the toner employed in the image forming method of the present invention, is, for example, 50-100° C., but is preferably 60-80° C.

Further, in the image forming method, releasing agents are employed which exhibit a melting point which is 50-100° C. lower than the surface temperature of the fixing nip section described below.

The melting point of releasing agents, which constitute toner employed in the image forming method of the present invention, refers to the temperature at the highest peak of the endothermic peak of releasing agents. It is possible to determine the above value employing, for example, "DSC-7 DIFFERENTIAL CALORIMETER" (produced by Perkin-Elmer Corp.) or "TAC7/DX THERMAL ANALYSIS UNIT CONTROLLER" (produced by Perkin-Elmer Corp.).

In practice, about 4.00 mg of releasing agents was collected and its weight was determined down to an accuracy of two decimal places. The resultant sample was sealed in an aluminum pan (KIT No. 0219-0041) and placed in a DSC-7 sample holder. Subsequently, heat-cool-heat temperature control was carried out under measurement conditions of a measurement temperature of 0-100° C., and a temperature increasing rate of 10° C./minute, and analysis was carried out based on data during the 2nd heating. An empty aluminum pan was employed for the reference measurement.

When a releasing agents is composed of at least two releasing agent components and results in at least two high peaks of the endothermic peak, it is necessary to employ the releasing agent in which each highest peak is 50-100° C. lower than the surface temperature of the fixing nip section.

The content of releasing agent in toner is preferably 1-30% by weight with respect to the total toner, but is more preferably 5-20% by weight.

(Production Method of Toner)

Methods to produce the toner of the present invention are not particularly limited. Listed as those may be a pulverization method, a suspension polymerization method, a mini-emulsion polymerization aggregation method, an emulsion polymerization aggregation method, a dissolution suspension method, a polyester molecule stretching method, as well as other ones known in the art. Of these, particularly preferred as a method to produce the toner of the present invention is the method called the mini-emulsion method as described below. A dispersion is prepared in such a manner that a polymerizable monomer solution which is prepared by dissolving releasing agents in polymerizable monomers is mechanically dispersed into an aqueous medium in which surface active agents at a concentration of at most critical micelle concentration are dissolved, to form oil droplets (at a size of 10-1,000 nm). Water-soluble polymerization initiators are added to the resulting dispersion to undergo radical polymerization. The resulting minute binder resin particles prepared via the above radical polymerization are coalesced (aggregated/fused), whereby a toner is prepared.

The reasons are assumed as follows. Since polymerization is performed in the above oil droplets, molecules of the releasing agents are securely included into the binding resins in toner particles. Consequently, until a fixing treatment in a fixing device, namely until heat application, generation of vaporized components of the releasing agents is retarded.

Further, in the above mini-emulsion polymerization aggregation method, instead of the addition of water-soluble polymerization initiators, or together with the same, oil-soluble radical polymerization initiators may be added to the above monomer solution.

As a method to produce the toner of the present invention, the minute binder resin particles, which are formed to employ the mini-emulsion polymerization aggregation method, may be applied to at least two layers composed of binding resins which differ in composition. In such a case, a method may be employed in which polymerization initiators and polymerizable monomers are added to the first resinous particle dispersion prepared via the mini-emulsion polymerization process (being the first stage polymerization), based on the conventional method and the resulting system undergoes polymerization process (being the second stage polymerization).

As a method to produce the toner of the present invention, one specific example which employs the mini-emulsion polymerization aggregation method is described below. The above method includes: (1) a dissolution-dispersion process to prepare a polymerizable monomer solution by dissolving in, or dispersing into polymerizable monomers forming binding resins toner particle, constituting materials such as releasing agents, colorants, and if desired, charge controlling agents, (2) a polymerization process in which the polymerizable monomer solution is dispersed into an aqueous medium to form oil droplets, whereby minute binding resin particle dispersion is prepared employing the mini-emulsion method, (3) an aggregation-fusion process in which aggregated particles are formed by salting out, aggregating, and fusing the minute binding resin particles in an aqueous medium, (4) a ripening process in which a toner particle dispersion is prepared by ripening the aggregated particles employing thermal energy to control their shape, (5) a cooling process which cools the toner particle dispersion, (6) a filtration and washing process in which targeted toner particles are separated from the cooled toner particle dispersion, and surface active agents and the like are further removed, (7) a drying process which dries the washed toner particles, and (8) a process in which any appropriate external additives are added to the dried toner particles.

Each of the processes will now be further described.

(1) Dissolution-Dispersion Process:

This process is one which prepares a polymerizable monomer solution by dissolving in, or dispersing into poylerizable monomers, toner constituting materials such as releasing agents or colorants.

The added amount of releasing agents is determined so as to have the above mentioned content of the releasing agents in the finally prepared toner.

Oil-soluble polymerization initiators and/or other oil-soluble components, described below, may be added to the above polymerizable monomer solution.

(2) Polymerization Process:

In one appropriate example of this polymerization process, the above polymerizable monomer solution is added to an aqueous medium incorporating surface active agents of a micelle concentration which is lower than the critical micelle concentration, followed by formation of oil droplets via application of mechanical energy, and subsequently, a polymerization reaction is performed in the above oil droplets via radicals from water-soluble radical polymerization initiators. Resin particles may have been added to the above aqueous medium as nucleus particles.

In this polymerization process, minute binding resin particles are prepared incorporating releasing agents and binding resins. These binding resin particles may or may no be colored. The minute colored binding resin particles are prepared by polymerizing monomer compositions incorporating colorants. Further, in the aggregation process described below, when minute non-colored binding resin particles are employed, a minute colorant particle dispersion is added to the minute binding resin particle dispersion, whereby toner particles are formed by aggregating the minute binding resin particles and the minute colorant particles.

"Aqueous medium", as described herein, refers to one in which the main component (at least 50% by weight) is water. In such case, listed as components other than water may be water-soluble organic solvents such as methanol, ethanol, isopropanol, butanol, acetone, methyl ethyl ketone, or tetrahydrofuran. Of these, particularly preferred are alcohol based organic solvents, such as methanol, ethanol, isopropanol, or butanol, which do not dissolve resins.

Methods to disperse the polymerizable monomer solution into the aqueous medium are not particularly limited. However, preferred is a method to carry out mechanical dispersion. Homogenizers which mechanically achieve oil droplet dispersion are not particularly limited, and examples include "CLEARMIX", ultrasonic homogenizers, mechanical type homogenizers, MANTON GAULIN, and pressure type homogenizers. Further, the dispersion particle diameter is commonly 10-1,000 nm, but is preferably 30-300 nm.

Homogenizers to mechanically achieve oil droplet dispersion are not particularly limited, and include a stirrer "CLEARMIX" (produced by M Technique Co., Ltd.) provided with a high speed rotating rotor, ultrasonic homogenizers, mechanical type homogenizers, MANTON GAULIN, and pressure type homogenizers. Further, the dispersion particle diameter is commonly 10-1,000 nm, but is preferably 30-300 nm.

(3) Aggregation-Fusion Process:

In the aggregation-fusion process, when the above minute binding resin particles are not colored, a minute colorant particle dispersion is added to the minute binding resin particle dispersion prepared via the above polymerization process, and the minute binding resin particles are salted out, aggregated and fused together with the above minute colorant particles. During the intermediate stage of the above aggregation-fusion process, it is possible to add minute binding resin particles which differ in resin compositions and to aggregate them.

Further, in the above aggregation-fusion process, it is possible to fuse internal additives such as a charge controlling agent together with the minute binding resin particles and minute colorant particles.

A preferred aggregation-fusion method is as follows. Salting-out agents composed of alkaline metal salts and/or alkaline earth metal salts as aggregating agents are added to an aqueous medium in which minute binding resin particles and minute colorant particles are present at a concentration of equal to or more than the critical aggregation concentration, and subsequently, by heating the mixture to a higher temperature than the glass transition point of the above minute binding resin particles, as well as the melt peak temperature of the employed releasing agents, salting-out is carried out, and simultaneously, also carried out is aggregation-fusion.

In this aggregation-fusion process, it is necessary to quickly elevate the temperature via heating, and the temperature elevation rate is preferably at least 1° C./minute. The upper limit of the temperature elevation rate is not particularly limited, but in view of retarding the formation of coarse particles during progress of rapid salting-out, aggregation, and fusion, the rate is preferably controlled to at most 15° C./minute.

Further, it is critical that after the temperature of the dispersion of minute binding resin particles and minute colorant particles exceeds the above glass transition temperature as well as the melt peak temperature of the releasing agents, salting-out, aggregation, and fusion are continued by maintaining the temperatures of the above dispersion for a definite period. Thus, it is possible to effectively carry out growth of toner particles (aggregation of minute binding resin particles and minute colorant particles) and fusion (disappearance of the interfaces between particles), whereby it is possible to enhance durability of f the finally prepared toner.

It is possible to prepare the minute colorant particle dispersion by dispersing colorants into an aqueous medium. Dispersion of minute colorant particles is carried out in such a manner that the concentration of surface active agents is maintained at equal to or more than the critical micelle concentration (CMC) in water. Homogenizers which are employed to achieve dispersion of minute colorant particles are not particularly limited, but preferred are ultrasonic homogenizers, mechanical homogenizers, pressure homogenizers such as MANTON GAULIN, or pressure-type homogenizers, sand grinders, as well as medium type homogenizers such a sand grinder, a GETZMANN mill, or a diamond fine mill.

These minute colorant particles may be subjected to surface modification. In practice, it is possible to prepare minute colorant particles modified by surface modifying agents in such a manner that minute colorant particles are dispersed into solvents; surface modifying agents are added to the resulting dispersion; the resulting mixture undergoes reaction by increasing the temperature; after completion of the reaction, minute colorant particles are collected via filtration; and after repeated washing employing the same solvents, drying is carried out.

(4) Ripening Process

It is preferable that the ripening process is carried out via a method employing thermal energy (heating).

Specifically, while stirring the system incorporating aggregated particles, toner particles are formed under regulation of the heating temperature, the stirring rate, and the heating period so that the shape of the aggregated particles reach the desired average circularity.

Further, in the above ripening process, a core/shell structure may be employed which is formed as follows. The above toner particles are employed as core particles. Minute binding resin particles are further added and adhered to the added core particles and the resulting particles are fused. In such a case, it is preferable that the glass transition temperature of minute binding resin particles constituting the shell layer is at least 20° C. higher than the glass transition temperature of the minute binding resin particles constituting the core particles.

(5) Cooling Process

This cooling process cools the above toner particle dispersion. The cooling rate in the cooling process is 1-20° C./minute. Methods of the cooling process are not particularly limited, and it is possible to exemplify a method in which cooling is carried out by feeding coolants from the exterior of the reaction vessel, as well as a method in which chilled water is directly charged into the reaction system.

(6) Filtration-Washing Process

In this filtration-washing process, toner particles are collected, via filtration, from the above toner particle dispersion cooled to the specified temperature in the above process via filtration and the collected toner particles (being a caked material) via filtration are washed to remove adhesives such as surface active agents, or salting-out agents, as well as alkali agents employed in the ripening process.

The above washing process is carried out via water washing until the electrical conductivity of the resultant filtrate reaches 10 μS/cm. Further, filtration methods include a centrifugal separation method, a vacuum filtration method carried out employing a Buchner'S funnel, and a filtration method employing a filter press, but filtration methods are not particularly limited.

(7) Drying Process:

This process is one in which the washed toner cake is dried to prepare dried toner particles. Listed as driers employed in this process may be spray driers, vacuum freeze driers, and vacuum driers. It is preferable to employ any of the stationary tray dryer, transportable tray dryer, fluid layer dryer, rotary type dryer and stirring type dryer. The moisture in the dried toner particles is preferably at most 5% by weight, but is more preferably at most 2% by weight. When dried toner particles are aggregated via weak attractive force among the particles, the above aggregates may be pulverized. Employed as a pulverizing means may be mechanical pulverizing apparatuses such as a jet mill, a HENSCHEL MIXER, a coffee mill, or a food processor.

(8) External Additive Incorporation Process

This process is one in which, if desired, external additives are incorporated in the dried toner particles. Employed as mixers for the addition of external additives may be mechanical mixers such as HENSCHEL MIXER or a coffee mill.

(Binding Resins)

When toner particles constituting the toner of the present invention are produced via a pulverizing method or a dissolution suspension method, employed as binding resins constituting the toner may be conventional resins such as vinyl based resins including styrene based resins, (meth)acryl based resins, styrene-(meth)acryl based copolymer resins, or olefin based resins, polyester based resins, polyamide based resins, carbonate resins, polyethers, polyvinyl acetate based resins, polysulfones, epoxy resins, polyurethane resins, or urea resins. These may be employed individually or in combinations of at least two types.

The toner particles composing toner of the present invention may be prepared by a suspension polymerization, mini-emulsion polymerization coagulation, emulsion polymerization coagulation method, and so on. The following polymerizable monomers may be employed to obtain a resin which composes of the toner, in such occasion. Examples include vinyl type monomer which includes;

styrene type monomer such as styrene, o-methylstyrene, m-methylstyrene, p-methylstyrene, α-methylstyrene, p-chlorostyrene, 3,4-dichlorostylene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, and their derivatives;

methacrylate derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate;

acrylate derivatives such as methyl acrylate, ethyl acrylate, isopropyl acrylate, n-butyl acrylate, isobutyl acrylate, t-butyl acrylate, n-octyl acrylate, 2-ethylhexyl acrylate, stearyl acrylate, lauryl acrylate, and phenyl acrylate; Olefin type monomer such as ethylene, propylene, and isobutylene;

halide vinyl such as vinyl chloride, vinylidene chloride, vinyl bromide, vinyl fluoride, and vinylidene fluoride; vinyl ester such as vinyl propionate, vinyl acetate, and vinyl benzoate;

vinyl ether such as vinyl methyl ether and vinyl ethyl ether:

vinyl ketone such as vinyl methyl ketone, vinyl ethyl ketone, and vinylhexyl ketone;

N-vinyl compound such as N-vinyl carbazole, N-vinyl indole, and N-vinyl pyrrolidone;

vinyl compound such as vinyl naphthalene and vinyl pyridine; and acrylate or methacrylate derivative such as acrylonitrile, methacrylonitrile and acryl amide.

These monomers may be employed singly or plurality in combination.

Further, it is preferable to employ in combination with those having an ionic dissociative group as a polymerizable monomer. Examples of polymerizable monomers having an ionic dissociative group include those which have substituents such as a carboxyl group, a sulfonic acid group, or a phosphoric acid. Specifically listed are acrylic acid, methacrylic acid, maleic acid, itaconic acid, cinnamic acid, fumaric acid, monoalkyl maleinate, monoalkyl itaconate, styrenesulfonic acid, allylsulfosuccinic acid, 2-acrylamido-2-methylpropanesulfonic acid, acid phosphoxyethyl methacrylate, and 3-chloro-2-acidphosphoxypropyl methacrylate.

Further, it is possible to prepare binding resins having a crosslinked structure, employing, as polymerizable monomers, multifunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentylglycol dimethacrylate, or neopentylglycol diacrylate.

(Surface Active Agents)

When toner particles constituting the toner of the present invention are produced employing a suspension polymerization method, a mini-emulsion polymerization aggregation method, or an emulsion polymerization aggregation method, the surface active agents employed to prepare binding resins are not particularly limited, but it is possible to exemplify, as appropriate surface active agents, ionic surface active agents such as sulfonates (sodium dodecylbenznesulfonate and sodium arylalkylpolyethersulfonate), sulfates (sodium dodecylsulfate, sodium tetradecylsulfate, sodium pentadecylsulfate, and sodium octylsulfate), fatty acid salts (sodium oleate, sodium laurate, sodium caprate, sodium caprylate, potassium stearate, and calcium oleate). Further, it is possible to employ nonionic surface active agents such as polyethylene oxide, combinations of polypropylene oxide with polyethylene oxide, esters of polyethylene glycol with higher fatty acids, esters of alkylphenol polyethylene oxide with higher fatty acids with polyethylene glycol, esters of higher fatty acids with polypropylene oxide, or sorbitan esters. When toner is prepared employing the emulsion polymerization method, these surface active agents are employed as an emulsifier, but they may be employed in the other processes or for other purposes.

(Polymerization Initiators)

When toner particles constituting the toner of the present invention are produced employing a suspension polymerization method, a mini-emulsion polymerization aggregation method or an emulsion polymerization aggregation method, it is possible to prepare binding resins via polymerization, employing radical polymerization initiators.

When a suspension polymerization method is employed, it is possible to employ oil-soluble radical polymerization initiators. Listed as such oil-soluble polymerization initiators may be azo based polymerization initiators such as 2,2'-(2,4-dimethylvaleronitrile), 2,2'-isonitrile, 1,1'-azobisisobutyronitrile, 1,1'-azobis(cyclohexane-1-carbonitrile), 2,2'-azobis-4-methoxy-2,4-dimethylvaleronitrile, azobisisobutyronitrile, peroxide based polymerization initiators such as benzoyl peroxide, methyl ethyl ketone peroxide, diisopropylperoxycarbonate, cumenehydroperoxide, t-butylhydroperoxide, di-t-butylperoxide, dicumylperoxide, 2,4-dichlorobenzoylperoxide, lauroylperoxide, 2,2-bis-(4,4-t-butylperoxycyclohexyl) propane, or tris-(t-butylperoxy) triazine, and polymer initiators having a peroxide on the side chain.

Further, when the mini-emulsion polymerization aggregation method or emulsion polymerization aggregation method is employed, it is possible to employ water-soluble radical polymerization initiators. Listed as water-soluble radical initiators may be persulfates such as potassium persulfate or ammonium persulfate, azobisaminodipropane acetates, azobiscyanovaleric acid and valerates thereof, and peroxide.

(Chain Transfer Agents)

When toner particles constituting the toner of the present invention are produced employing the suspension polymerization method, the mini-emulsion polymerization aggregation method, or the emulsion polymerization aggregation method, it is possible to employ common chain transfer agents to control the molecular weight of binding resins.

Chain transfer agents are not particularly limited, and for example, mercaptans such as n-octyl mercaptan, n-decylmercaptan, or tert-dodecylmercaptan, as well as n-octyl-3-methylmerccaptopropionates, terpinorene, carbon tetrabromide, and α-methylstyrene dimer are employed.

An organic or inorganic colorant may be employed in the toner of the present invention. Typical examples thereof are listed.

Employed as black pigments are, for example, carbon black such as furnace black, channel black, acetylene black, thermal black, lamp black, and the like, and in addition, magnetic powders such as magnetite, ferrite, and the like.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48;1, C.I. Pigment Red 53;1, C.I. Pigment Red 57;1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 12, C.I. Pigment Yellow 13, C.I. Pigment Yellow 14, C.I. Pigment Yellow 15, C.I. Pigment Yellow 74, C.I. Pigment Yellow 93, C.I. Pigment Yellow 94, C.I. Pigment Yellow 138, and the like.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, C.I. Pigment Blue 66, C.I. Pigment Green 7, and the like.

If desired, these inorganic pigments may be employed individually or in combination of a plurality of these. Further, the added amount of said pigments is commonly between 1 and 30 percent by weight with respect to the polymer, and is preferably between 2 and 20 percent by weight.

The colorants may also be employed while subjected to surface modification. As said surface modifying agents may be those conventionally known in the art, and specifically, preferably employed may be silane coupling agents, titanium coupling agents, aluminum coupling agents, and the like.

(Aggregating Agents)

When toner particles constituting the toner of the present invention are produced employing the mini-emulsion polymerization aggregation method or the emulsion polymerization aggregation method, listed as aggregating agents employed to prepare binding resins may, for example, be alkaline metal salts or alkaline earth metal salts. Alkaline metals constituting the aggregating agents include lithium, potassium, and sodium, while alkaline earth metals constituting the same include magnesium, calcium, strontium, and barium. Of these, preferred are potassium, sodium, magnesium, calcium, and barium. Counter ions (being anions constituting salts) of the above alkaline or alkaline earth metals include chloride ions, bromide ions, iodide ions, carbonate ions, and sulfate ions.

(Charge Controlling Agents)

If desired, charge controlling agents may be incorporated in the toner particle constituting the toner of the present invention. Employed as charge controlling agents may be various compounds.

(Diameter of Toner Particles)

The diameter of toner particles of the present invention is preferably 3-8 μm in terms of number average particle diameter. When toner particles are formed employing a polymerization method, it is possible to control the above diameter based on the concentration of aggregating agents, the addition amount of organic solvents, the fusing period, and further, the compositions of the polymer itself.

By controlling the number average particle diameter within 3-8 μm, it is possible to realize the desired fine line reproduction and high quality image, and at the same time, it is possible to reduce toner consumption compared to the case in which larger diameter toner particles are employed.

(Average Circularity of Toner Particles)

In view of enhancement in transfer efficiency of each toner particle of the toner of the present invention, the average circularity represented by following Formula (3) is preferably 0.930-1.000, but is more preferably 0.950-0.995.

Average circularity=peripheral length of circle obtained via circle equivalent diameter/peripheral length of the projective particle image Formula (3)

(External Additives)

In the toner employed in the image forming method of the present invention, to improve fluidity and charging properties, and to enhance cleaning properties, so-called external additives may be added and employed. These external additives are not particularly limited, and various minute inorganic and organic particles and lubricants are usable.

As such minute inorganic particles, it is preferable to employ particles composed of inorganic materials such as silica, titania or alumina. Further, it is preferable that these minute inorganic particles are subjected to hydrophobic treatment employing silane coupling agents or titanium coupling agents. Further, employed as minute organic particles may be spherical ones of a number average primary particle diameter of about 10-2,000 nm. Employed as such minute organic particles may be those composed of polystyrene, polymethyl methacrylate, and styrene-methyl methacrylate copolymers.

The content of these external additives is commonly 0.1-5.0% by weight with respect to the toner, but is preferably 0.5-4.0% by weight. Further, external additives may be employed in combinations of various types.

(Developers)

The toner employed in the image forming method of the present invention may be employed as a developer of a magnetic or non-magnetic single component developer, but may also be employed as a double component developer upon being blended with carriers. When the toner employed in the image forming method in the present invention is employed as a single component toner, listed are a non-magnetic single component developer or a magnetic single component developer in which magnetic particles at about 0.1-about 0.5 μm are incorporated, both of which are usable. When the toner employed in the image forming method of the present invention is employed as a double component developer, it is possible to employ, as carriers, magnetic particles composed of metals such as iron, ferrite, or magnetite, or alloys of the above metals with metals such as aluminum or lead. Of these, ferrite particles are particularly preferred. Further employed as carriers may be coated carriers in which the surface of magnetic particles are covered with covering agents such as resins, and resin dispersion type carriers which are prepared by dispersing minute magnetic material particles into binder resins.

Covering resins which constitute coated carriers are not particularly limited, and examples include olefin based resins, styrene based resins, styrene-acryl based resins, silicone based resins, ester resins, and fluorine containing polymer based resins. Further, resins constituting resin dispersion type carriers are not particularly limited, and all those known in the art are usable. For example, employed may be styrene-acryl based resins, polyester resins, fluororesins, and phenol resins.

In view of minimizing the formation of liberated external additives and durability, coated carriers covered with styrene-acryl based resins as a covering resin are listed as preferred carriers.

The volume average particle diameter of carriers is preferably 20-100 μm, but is more preferably 25-80 μm. It is possible to determine the volume average particle diameter of carriers, employing a typical instrument such as a laser diffraction system particle size distribution measuring apparatus, "HELOS" (produced by SYMPATEC Co.) provided with a wet type homogenizer.

By employing the above image forming method, releasing agents incorporated in the used toner exhibit the specified dynamic viscosity and the melting point of the same is controlled within the specified range upon considering the relationship with the fixing temperature in the fixing device. Consequently, even though high-rate fixing is carried out at a lower fixing temperature, the releasing agents sufficiently melt to result in high strength fixing. As a result, generation of offsetting is retarded and at the same time, image effects in the from of banding and streaking are minimized due to the fact that the releasing agents hardly generate vaporized components, whereby it is possible to prepare desired fixed images.

EXAMPLES

Examples of the present invention will now be described.

Resin Particle Dispersion Production Example 1

(First Stage Polymerization)

Charged into a 5 L reaction vessel fitted with a stirrer, a temperature sensor, a cooling pipe, and a nitrogen introducing unit, was a solution which was prepared by dissolving 8 g of sodium dodecylsulfate in 3 L of ion-exchanged water. While stirring at a rate of 230 rpm under a flow of nitrogen, the interior temperature was increased to 80° C. After the temperature increase, a solution which was prepared by dissolving 10 g of potassium persulfate in 200 g of ion-exchanged water was added, and the temperature was again raised to 80° C. After dripping, over one hour, a polymerizable monomer solution composed of 480 g of styrene, 250 g of n-butyl acrylate, 68.0 g of methacrylic acid, and 16.0 g of n-octyl-3-mercaptopropionate, while stirring, the resulting mixture underwent polymerization at 80° C. for two hours, whereby resin particle dispersion (1H) incorporating resin particles (1h) was prepared.

(Second Stage Polymerization)

Charged into a 5 L reaction vessel fitted with a stirrer, a temperature sensor, a cooling pipe, and a nitrogen introducing unit, was a solution which was prepared by dissolving 7 g of sodium polyoxyethylene-2-dodecylethersulfate in 800 ml of ion-exchanged water. After increasing the temperature to 98° C., 260 g of above resin particle dispersion (1H) and a polymerizable monomer solution prepared by dissolving, at 90° C., 245 g of styrene, 120 g of n-butyl acrylate, 1.5 g of n-octyl-3-mercaptopropionate, and 67 g of releasing agent (2) "HNP-11" shown in Table 1 were added, and the resulting mixture was mix-dispersed over one hour, employing a mechanical type homogenizer, "CLEARMIX" (produced by M Technique Co.), whereby a dispersion incorporating emulsified particles (oil droplets) was prepared.

Subsequently, an initiator solution prepared by dissolving 6 g of potassium persulfate in 200 ml of ion-exchanged water was added to the above dispersion, and while stirring, the resulting system underwent polymerization at 82° C. for one hour, whereby resin particle dispersion (1HM) incorporating resin particles (1hm) was prepared.

(Third Stage Polymerization)

A solution prepared by dissolving 11 g of potassium persulfate in 400 ml of ion-exchange water was added to the above resin particle dispersion (1HM) and at 82° C., a polymerizable monomer solution composed of 435 g of styrene, 130 g of n-butyl acrylate, 33 g of methacrylic acid, and 8 g of n-octyl-3-mercaptopropionate was dripped over one hour. After dripping, while stirring and heating, the resulting mixture underwent polymerization over two hours. Thereafter, the resulting reaction products were cooled to 28° C., whereby Resin Particle "a" Incorporating Resin Particle Dispersion A was prepared. The diameter of Resin Particles "a" in above Resin Particle Dispersion A was determined employing an electrophoretic light scattering photometer "ELS-800" (produced by Otsuka Electronics Co., Ltd.), resulting in 150 nm in terms of volume based median diameter. Further, the glass transition temperature of above Resin Particles "a" resulted in 45° C.

Resin Particle Dispersion Production Examples 2-13

Resin Particle Dispersions B-M are prepared in the same manner as Resin Particle Dispersion Production Example 1, except that each of the releasing agents listed in Table 1 was employed in the formulation shown in Table 2.

TABLE 1

| Releasing Agent No. | Releasing Agent Component | Trade Name | Dynamic Viscosity ($mm^2/s$) | Melting Point (° C.) |
|---|---|---|---|---|
| 1 | paraffin wax | 130 | 3.8 | 55 |
| 2 | paraffin wax | HNP-11 | 4.3 | 68 |
| 3 | paraffin wax | HNP-9 | 6.9 | 75 |
| 4 | Fischer-Tropsch wax | HNP-51 | 7.1 | 77 |
| 5 | monoester compound | WEP-3 | 9.5 | 71 |
| 6 | Fischer-Tropsch wax | FNP0090 | 12.2 | 90 |
| 7 | microcrystalline wax | HNP-0190 | 14.5 | 80 |
| 8 | polyhydric ester compound | WEP-6 | 19.2 | 77 |
| 9 | polyhydric ester compound | WEP-5 | 23.5 | 83 |

Minute Colorant Particle Dispersion Production Example 1

While stirring a solution prepared by dissolving 90 g of sodium dodecyl sulfate in 1,600 ml of ion-exchanged water, 420 g of carbon black "REGAL 330R" (produced by Cabot Co.) was gradually added. Subsequently, the resulting mixture was dispersed employing a stirrer, "CLEARMIX" (produced by M Technique Co.), whereby Minute Colorant Particle Dispersion Q was prepared. The diameter of the minute colorant particles in above Minute Colorant Particle Dispersion Q was determined employing an electrophoretic light scattering photometer, "ELS-800" (produced by Otsuka Electronics Co., Ltd.), resulting in 110 nm in terms of the volume based median diameter.

Minute Colorant Particle Dispersion Production Example 2

Minute Colorant Particle Dispersion R was prepared in the same manner as Minute Colorant Particle Dispersion Production Example 1, except that 420 g of carbon black was replaced with 310 g of C. I. Pigment Yellow 74. The diameter of the minute colorant particles in above Minute Colorant Particle Dispersion R was determined employing an electrophoretic light scattering photometer, "ELS-800" (produced by Otsuka Electronics Co., Ltd.), resulting in 150 nm in terms of the volume based median diameter.

Minute Colorant Particle Dispersion Production Example 3

Minute Colorant Particle Dispersion S was prepared in the same manner as Minute Colorant Particle Dispersion Production Example 1, except that 420 g of carbon black was replaced with 310 g of C. I. Pigment Red 122. The diameter of the minute colorant particles in above Minute Colorant Particle Dispersion S was determined employing an electrophoretic light scattering photometer, "ELS-800" (produced by Otsuka Electronics Co., Ltd.), resulting in 150 nm in terms of the volume based median diameter.

Minute Colorant Particle Dispersion Production Example 4

Minute Colorant Particle Dispersion T was prepared in the same manner as Minute Colorant Particle Dispersion Production Example 1, except that 420 g of carbon black was replaced with 310 g of C. I. Pigment Blue 15. The diameter of the minute colorant particles in above Minute Colorant Particle Dispersion T was determined employing an electrophoretic light scattering photometer, "ELS-800" (produced by Otsuka Electronics Co., Ltd.), resulting in 150 nm in terms of the volume based median diameter.

Toner Particle Production Example 1

Charged into a 5 L reaction vessel fitted with a stirrer, a temperature sensor, a cooling pipe, and a nitrogen introducing unit, were 300 g in terms of solids of Resin Particle Dispersion A, 1,400 g of ion-exchanged water, 120 g of Minute Colorant Particle Dispersion Q, and a solution prepared by dissolving 3 g of sodium polyoxyethylene-2-dodecylether sulfate in 120 ml of ion-exchanged water, and the temperature of the resulting mixture was controlled to 30° C. Thereafter, the pH was adjusted to 10 by the addiction of a 5N aqueous sodium hydroxide solution. Subsequently, an aqueous solution prepared by dissolving 35 g of magnesium chloride in 35 ml of ion-exchanged water was added while stirring at 30° C. over 10 minutes. After allowing to stand for 3 minutes, the temperature was increased to 90° C. over 10 minutes and the particle growth reaction was allowed to continue while maintained at 90° C. In such a state, the diameter of coalesced particles was determined employing "Coulter Multisizer III". When the particle diameter reached the specified value, the particle growth was terminated by the addition of an aqueous solution prepared by dissolving 150 g of sodium chloride in 600 ml of ion-exchanged water. Further, as a fusion process, until the average circularity determined employing "FPIA-2100" reached 0.965, fusion between particles was progressed wile stirring at a liquid temperature of 98° C. Thereafter, the liquid was cooled to 30° C., and the pH was adjusted to 4.0 by the addition hydrochloric acid, followed by termination of stirring.

The toner particles formed during the above process was subjected solid-liquid separation employing a basket type centrifuge, "MARK III Type No. 60D40", produced by MATSUMOTO KIKAI MFG. Co., Ltd.), and a toner particle wet cake was prepared. The resulting wet cake was washed with ion-exchanged water of a temperature of 45° C. in the above basket type centrifuge, until the electrical conductivity of the effluent reached 5 μS/cm. Thereafter, the washed cake was transferred to "FLUSH JET DRYER" (produced by Seishin Enterprise Co., Ltd.) and dried until the water content reached 0.5% by weight, whereby toner particles were prepared.

Added to the resulting toner were 1% by weight of hydrophobic silica (at a number average primary particle diameter of 12 nm) and 0.3% by weight of hydrophobic titania (at a number average primary particle diameter of 20 nm), and the resulting composition was mixed employing HENSCHEL MIXER, whereby Toner 1Bk composed of Toner Particles 1Bk was prepared.

Further, the shape and particle diameter of these toner particles were not varied by the addition of hydrophobic silica and hydrophobic titanium oxide.

Toner Particle Production Examples 2Bk-13Bk

Toners 2Bk-13Bk composed of Toner Particles 2Bk-13 Bk were prepared in the same manner as Toner Particle Production Example 1, except that Resin Particle Dispersion A was replaced with each of Resin Particle Dispersions B-M.

Toner Particle Production Examples 1Y-13Y

Toners 1Y-13Y composed of Toner Particles 1Y-13Y were prepared in the same manner as Toner Particle Production Examples 1Bk-13Bk, except that Minute Colorant Particle Dispersion Q was replaced with Minute Colorant Particle Dispersion R.

Toner Particle Production Examples 1M-13M

Toners 1M-13M composed of Toner Particles 1M-13M were prepared in the same manner as Toner Particle Production Examples 1Bk-13Bk, except that Minute Colorant Particle Dispersion Q was replaced with Minute Colorant Particle Dispersions S.

Toner Particle Production Examples 1C-13C

Toners 1C-13C composed of Toner Particles 1C-13C were prepared in the same manner as Toner Particle Production Examples 1Bk-13Bk, except that Minute Colorant Particle Dispersion Q was replaced with Minute Colorant Particle Dispersions T.

Developer Production Examples 1Bk-13Bk, 1M-13Y, 1M-13M and 1C-13C

Developers 1Bk-13Bk, 1Y-13Y, 1M-13M, and 1C-13C were prepared by blending silicone resin-coated ferrite carriers of a volume average particle diameter of 60 μm to reach a toner concentration of 6% with each of Toner Particles 1Bk-13Bk, 1Y-13Y, 1M-13M, and 1C-13C Examples 1-9 and Comparative Examples 1-4

Developers 1Bk-13Bk, 1Y-13Y, 1M-13M, and 1C-13C, prepared as above, were employed under combinations of (1Bk, 1Y, 1M, 1C)-(13Bk, 13Y, 13M, 13C). The following tests were performed employing a digital copier "BIZHUB PRO C450" (produced by Konica Minolta Holdings, Inc.), provided with the following fixing device and the following tests were performed, whereby evaluations (I) and (II) were carried out. Table 2 shows the results.

(Fixing Device)

As shown in FIG. 1, the fixing device employs a contact heating system and includes a heating roller which is prepared in such a manner that a heat-resistant elastic layer composed of a 1.5 mm thick silicone rubber is formed on an cylindrical aluminum core, including a halogen heater lamp and further, a 30 μm thick toner releasing layer composed of PFA resins is formed via a single adhered layer; a supporting roller which is arranged parallel to but separated from the above heating roller, which is prepared by covering the surface of a cylindrical iron core metal (at an inner diameter of 40 mm and a wall thickness of 2.0 mm) with a sponge silicone rubber (at an Asker hardness of 48° and a thickness of 2 mm); a pressure roller which is prepared by covering the surface of a cylindrical iron core metal (at an inner diameter of 40 mm and a wall thickness of 2.0 mm) with sponge-shaped silicone rubber (at an Asker hardness of 48° and a wall thickness of 2.0 mm), which is brought into contact with the above supporting roller under a total load of 150 N to form a fixing nip section at a nip width of 5.8 mm; and a fixing belt which is entrained on the heating roller and the supporting roller, which is prepared in such a manner that a Si rubber layer at a thickness of 200 μm is formed on the peripheral surface of a 40 μm thick Ni-plated substrate and a 300 mm thick covering layer composed PFA (tetrafluoroethylene-perfluoroalkyl vinyl ether copolymers) is formed on the peripheral surface of the above Si rubber layer.

Further, the fixing device was employed under the following conditions. With regard to the fixing temperature, the surface temperature of the heating roller was set at the temperature listed in Table 2. In Examples 1-6 and 9, as well as Comparative Examples 1-4, the printing rate was set at 300 mm/second, in Example 7, the same was set at 400 mm/second, while in Example 8, the same was set at 490 mm/second.

(Tests)

At normal temperature and humidity (20° C. and 55% relative humidity), a 5 cm×5 cm solid black image at a density of 1.0 was initially formed on the first sheet of "J PAPER" (produced by Konica Minolta Holdings, Inc.) at 64 g/m$^2$. Subsequently, mixed images including text at a pixel ratio of 7%, a portrait, and a cyan halftone solid image at a density of 0.6 as test images were formed on the second sheet, and the same images were continuously formed on 10,000 sheets.

(I) Image Problems

Of images formed during the above test, image defects in the form of banding and white streaking of the test image appearing on the 10,000th sheet were visually observed and evaluated based on the following criteria:

"A": no image defects were noted

"B": in the cyan halftone solid image, slightly lowered density areas in the form of streaking were noted "C": in the cyan halftone solid image, several areas of white streaking were noted, but in the text and a portrait, they were barely noted, resulting in a commercially viable image "D": in the cyan halftone image, white streaking was clearly noted, resulting in a commercially unviable image (II) Offsetting Resistance (Fixing Ratio)

In the above tests, the fixing ratio of a solid black image formed on the first sheet was calculated based on measurement of the fixing strength employing a tape peeling method. Based on the resulting fixing ratio, evaluation was perfumed based on the following criteria:

"A": the fixing ratio was at least 95%

"B": the fixing ration was at least 85—less than 95%

"C": the fixing ratio was at least 80—less than 85%

"D": the fixing ratio was less than 80%

(Mending Tape Peeling Method)

1) Absolute reflection density DO of the solid black image was determined.
2) MENDING TAPE "No. 810-3-12" (produced by Sumitomo 3M Co.) was lightly adhered onto the solid black image.
3) Pressure of 1 kPa was applied back and forth 3.5 times onto the MENDING TAPE.
4) The MENDING TAPE was peeled away at an angle of 180° employing a force of 200 g.
5) After peeling, absolute reflection density D1 was determined.
6) The fixing ratio is calculated based on following Formula (2).

$$\text{Fixing ratio (\%)} = D1/D0 \times 100 \qquad \text{Formula (2)}$$

The absolute density was determined employing a reflection densitometer "RD-918" (produced by Macbeth Co.).

TABLE 2

| | Toner | Releasing Agent: Releasing Agent No. | Releasing Agent: Addition Amount (%) | Fixing Temperature (° C.) | Difference between Melting Point of Releasing Agent and Fixing Temperature | Evaluation Result: Image Problem | Evaluation Result: Offsetting Resistance |
|---|---|---|---|---|---|---|---|
| Example 1 | 1 | 2 | 5 | 165 | 97 | B | B |
| Example 2 | 2 | 3 | 10 | 150 | 75 | B | B |
| Example 3 | 3 | 4 | 10 | 150 | 73 | B | B |
| Example 4 | 4 | 5 | 10 | 160 | 89 | A | B |
| Example 5 | 5 | 6 | 10 | 170 | 80 | B | A |
| Example 6 | 6 | 7 | 15 | 160 | 80 | A | A |
| Example 7 | 7 | 8 | 15 | 170 | 93 | B | B |
| Example 8 | 8 | 3/8 | 7.5/7.5 | 160 | 85/83 | B | C |
| Example 9 | 9 | 5/7 | 10/10 | 160 | 89/80 | A | A |
| Comparative Example 1 | 10 | 1 | 10 | 140 | 85 | C | B |
| Comparative Example 2 | 11 | 9 | 10 | 160 | 77 | B | D |
| Comparative Example 3 | 12 | 3 | 10 | 140 | 65 | A | D |
| Comparative Example 4 | 13 | 2 | 10 | 170 | 102 | C | B |

As can clearly be seen from the results in Table 2, in Examples 1-9 according to the image forming method of the present invention, even when fixing was carried out at a low temperature, no image defects in the form of white streaking or banding resulted and fixing was also carried out at a sufficient fixing strength, whereby generation of the phenomena of offsetting was retarded.

The invention claimed is:

1. An image forming method comprising:

forming a toner image on an image support, fixing the toner image on the image support in a fixing nip section of a fixing device employing a contact heating system;

wherein the toner contains a first releasing agent, the first releasing agent is microcrystalline wax, a dynamic viscosity of the first releasing agent is 8-15 $mm^2$/sec;

a fixing temperature in the fixing nip section of the fixing device is 50-100° C. higher than a melting point of the first releasing agent; and the transport rate in the fixing nip section is 230-500 mm/sec.

2. The image forming method of claim 1, wherein the melting point of the first releasing agent is 50-100° C.

3. The image forming method of claim 1, wherein the toner contains a second releasing agent which has a dynamic viscosity of 8-15 $mm^2$/sec.

4. The image forming method of claim 1, wherein the transport rate in the fixing nip section is 230-400 mm/sec.

5. The image forming method of claim 1, wherein the microcrystalline wax has a weight average molecular weight of 600-800.

6. The image forming method of claim 5, wherein the microcrystalline wax has a number average molecular weight of 300-1,000.

7. The image forming method of claim 6, wherein the microcrystalline wax has a number average molecular weight of 400-800.

8. The image forming method of claim 6, wherein the microcrystalline wax has a ratio of the weight average molecular weight to the number average molecular weight (Mw/Mn) of 1.01-1.20.

9. An image forming method comprising:

forming a toner image on an image support, fixing the toner image on the image support in a fixing nip section of a fixing device employing a contact heating system;

wherein the toner contains a first releasing agent which has a dynamic viscosity of 8-15 $mm^2$/sec;

the toner contains a second releasing agent which has a dynamic viscosity of 8-15 $mm^2$/sec, a fixing temperature in the fixing nip section of the fixing device is 50-100° C. higher than a melting point of the first releasing agent; and the transport rate in the fixing nip section is 230-500 mm/sec.

10. The image forming method of claim 9, wherein the first releasing agent is Fischer-Tropsch wax, paraffin wax, microcrystalline wax or mono-ester wax.

* * * * *